United States Patent [19]

Coupe

[11] 4,047,761

[45] Sept. 13, 1977

[54] MINING MACHINE

[75] Inventor: Edward Gordon Coupe, Newark, England

[73] Assignee: Dosco Overseas Engineering Limited, England

[21] Appl. No.: 610,673

[22] Filed: Sept. 5, 1975

[51] Int. Cl.[2] ..... E21C 35/20

[52] U.S. Cl. ..... 299/64; 299/11; 299/18; 299/75; 198/312

[58] Field of Search ..... 299/64, 75, 67, 68, 299/18, 11; 198/312, 313

[56] References Cited

U.S. PATENT DOCUMENTS

| | | | |
|---|---|---|---|
| 2,025,306 | 12/1935 | Pray | 299/64 |
| 2,210,919 | 8/1940 | Joy | 299/64 |
| 2,392,697 | 1/1946 | Russell et al. | 198/312 X |
| 2,642,981 | 6/1953 | Lindgren | 299/64 X |
| 2,721,067 | 10/1955 | Russell et al. | 299/64 |
| 2,729,002 | 1/1956 | Hedgecock | 299/64 X |
| 3,479,090 | 11/1969 | McCracken | 299/64 |
| 3,788,452 | 1/1974 | McWilliams | 198/313 |
| 3,873,157 | 3/1975 | Stoltefuss et al. | 299/75 X |

*Primary Examiner*—Ernest R. Purser
*Assistant Examiner*—William F. Pate, III
*Attorney, Agent, or Firm*—Diller, Brown, Ramik & Wight

[57] ABSTRACT

A mining machine suitable for cutting roadways in coalmines comprises a cutting head, a conveyor for moving mined material rearwardly of the machine and a discharge conveyor for unloading the mined material to one side of the machine. As the machine advances the discharge conveyor can be used selectively to unload coal onto a stage loader and other material into pack-holes, thereby saving labor. The discharge conveyor may be pivotable about horizontal and/or vertical axes, longitudinally extendable or movable relative to the machine or cutting head to obtain maximum control over the area in which it discharges material.

12 Claims, 10 Drawing Figures

MINING MACHINE

This invention relates to mining machines and is particularly applicable to a tunnelling machine of the type which is commonly used for tunnelling roadways in, for example, coal mines.

Normally, when a seam of coal is to be mined, parallel roadways are driven through the seam at the same time as coal in the seam between the roadways is being mined. As the roadway progresses, it is of course necessary to have it shored by means of, for example, timbers or metal girders, because the roadway is an essentially permanent structure, serving to bring mining machinery to the coal face and also to convey the mined coal away from the face. The roadways are therefore of substantial size, being usually about 16 feet in width and a maximum of 12 feet in height.

While there are clearly local variations, the average height of a coal seam is about 4 feet, so that, as the roadway is tunnelled through a seam, only about 4 feet of the height of roadway comprises coal, the remainder of the volume being of other stone.

The tunnelling machine which makes the roadway therefore removes a substantial amount of rubble, and this serves a very useful purpose, being packed into the packhole which is the space left between adjacent roadways where the coal seam has been mined. It is necessary that the packhole be filled with material to within a few feet of the working face of the coal seam, in order to avoid collapse of the seam. Up to now, this packing operation has been done manually, the tunnelling machine simply conveying rubble to the rear of the machine, which rubble is then packed by miners into the packhole.

Even when the tunnelling machine is itself mining coal, this also is simply deposited behind the machine by means of a conveyor and it must then be loaded onto a stage loader, that is a loader running the length of the roadway in order to convey coal away from the face. Clearly, during the process of tunnelling the roadway, there are several manual operations which must be carried out for the work to proceed normally.

The cutting machine used for this purpose is normally a tracked vehicle carrying a telescopic boom mounted on a turntable and also pivotable about a horizontal axis. At the forward end of the boom, there is a cutting head which of course engages the rock or coal face. Rubble which is drilled out by the cutting head falls to the ground and, as the vehicle moves forward, is gathered up by an apron on the front of the machine at ground level, and is thus transferred to a conveyor extending backwards into the machine. At some point, material carried by this conveyor drops into a hole in the centre of the machine, and is picked up by a second conveyor which extends rearwardly of the machine itself. As explained above, this material, if it be coal, must then be loaded onto the stage loader and, if it be rubble, it must be manually packed into the packhole.

The present invention seeks to provide a mining machine which reduces the need for manual labour at the coal face, and which itself can deposit coal or rubble to the side of the machine.

According to the present invention, there is provided a mining machine having at least one cutting head and adapted for forward movement against a face to be cut, and comprising means for conveying mined material towards the back of the machine and a discharge conveyor extending in a direction transverse to the direction of movement of the mining machine for unloading the mined material to one side of the machine.

Preferably, the mining machine comprises a telescopic boom on which the cutting head is mounted. The boom may be pivoted about a vertical and also a horizontal axis, so that the cutting head can be used to tunnel out a roadway as the machine progresses. The means for conveying mined material towards the back of the machine may be constructed in any one of a number of forms. Thus, in one embodiment the said means includes a gathering apron for collecting the mined material from in front of the machine, gathering arms for sweeping material on the gathering apron towards a central position, and a centrally located conveyor for conveying the mined material rearwardly from the central position on the gathering apron. In an alternative arrangement the means for conveying mined material towards the back of the machine comprises a conveyor for conveying mined material in front of the machine transversely towards one side of the machine and subsequently rearwardly of the machine to the discharge conveyor. In this latter arrangement the conveyor is conveniently constructed in the form of an endless chain conveyor encircling the front part of the machine.

The discharge conveyor may be of fixed length but is preferably extendable, e.g. so that the mined material can be deposited in any one of a plurality of locations at varying distances from the side of the machine. This feature of the invention is particularly advantageous, because it allows different materials to be selectively deposited at different points. For example, when the material being mined is coal, the conveyor can be arranged so that the coal falls directly on to the stage loader running alongside the machine in the roadway. Alternatively, when the material is rock or rubble, the conveyor can be extended to such a length that the rubble is automatically deposited into the packhole behind the working face of the coal seam. In this way, a substantial amount of the manual work necessary at present is avoided.

In order to achieve better packing of rubble into the packhole the discharge conveyor may be pivotably mounted on the machine for rotation about a horizontal axis, so that the height of its discharge end may be varied. Also, it may be pivotably mounted on the machine for rotation about a vertical axis, so that it can continue to discharge rubble or coal at the same location, even when the machine itself has moved forward in the course of the tunnelling operation.

In order to enable even better control to be exercised over the location at which material is deposited from the discharge conveyor, the discharge conveyor and the means for conveying mined material towards the back of the machine may be mounted on the machine for relative movement in the direction of movement of the machine. Thus, in a preferred embodiment, the means for conveying mined material towards the back of the machine is mounted on a main frame of the machine and the discharge conveyor is mounted for forward and rearward movement on the main frame. As the machine advances therefore, the discharge conveyor may be moved rearwardly relative to the main frame so that it continues to deposit mined material in the same location to one side of the machine.

Alternatively, the discharge conveyor may be mounted on a main frame of the machine and the cutting head and the means for conveying material towards the back of the machine may be mounted on a sub-frame which is itself mounted for forward and rearward movement on the main frame. Since the main frame of the machine normally comprises a tracked vehicle which is moved forward into a drilling position, the latter arrangement has the additional advantage of allowing the tracked vehicle to remain stationary, while the cutting head is advanced on the slidable sub-frame. This arrangement tends to minimise the danger of the vehicle itself becoming bogged down, as can happen when the drive of the main frame (i.e. the tracked drive) is used for force cutting against the face.

In order that the invention may be better understood embodiments thereof will now be described by way of example only, with reference to the accompanying schematic drawings, in which.

Figure 1:
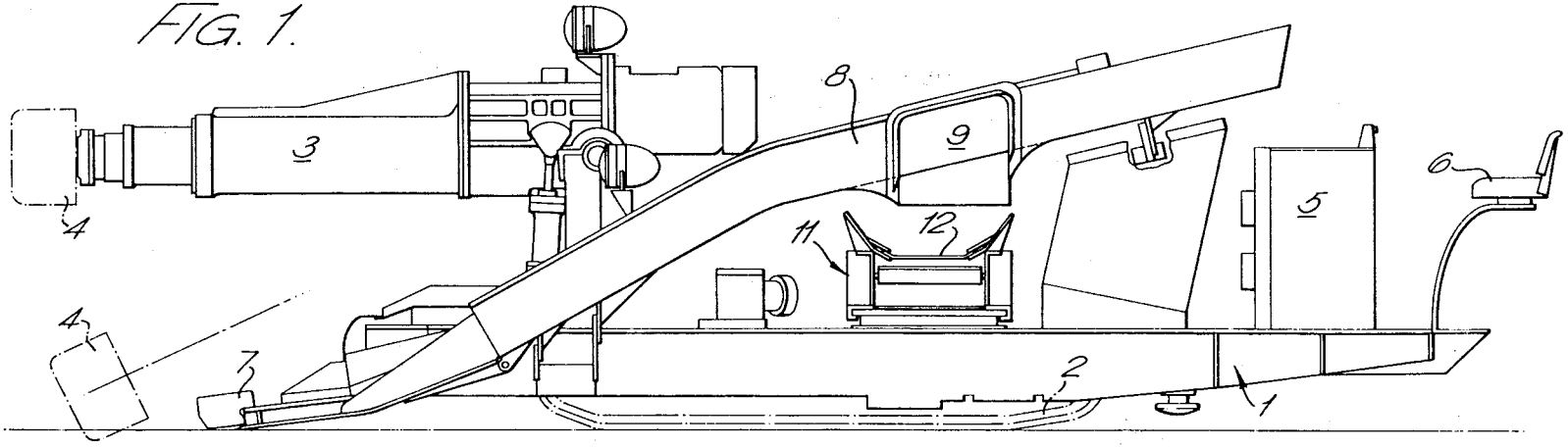
FIG. 1 is a side elevation of a first embodiment of a mining machine.
Figure 2:
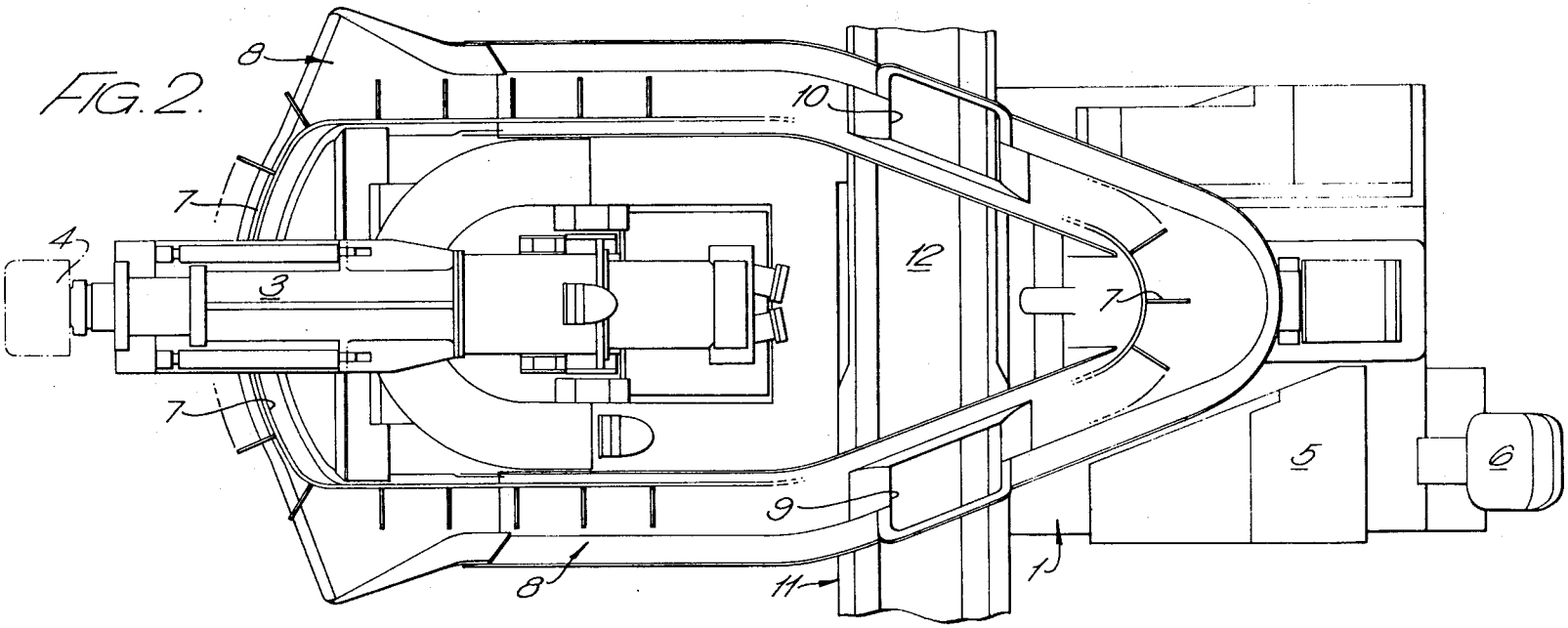
FIG. 2 is a plan view of the machine of FIG. 1.

Referring to FIGS. 1 and 2, there is shown a tunnelling machine having a main frame 1 which is supported on caterpillar tracks 2 for movement in forward and reverse directions. Mounted on the frame 1 is a telescopic boom 3 which, at its forward end, carries a cutting head 4. The boom 3 is capable of pivotal movement about horizontal and vertical axes. The cutting head 4 is shown in FIG. 1 in dot-dash lines in its lowermost position at ground level.

The mounting and operation of the boom 3 on the machine is entirely conventional and well-known in the art. The machine is normally used for tunnelling roadways in coal mines and, with its range of movement, can tunnel out an arched roadway of about 16 feet in height and 12 feet in width. The various controls of the machine are operated hydraulically and a power pack 5 is provided at the rear of the machine. A seat 6 is provided at the rear of the machine for the operator.

Material cut by the machine falls to the ground and is gathered up by an endless conveyor chain 7 which encircles the front part of the machine and runs in a tray 8 extending across the front of the machine at ground level and rising up both sides of the machine towards the rear. Towards the rear of the machine, there is provided in the tray at both sides of the machine apertures 9 and 10 through which material conveyed by the chain 7 can fall. The conveyor chain 7 therefore conveys mined material in front of the machine transversely across the machine towards one side, rearwardly up the tray 8 and along the side of the machine towards the aperture 9 or 10. Material falling through either one of the apertures 9 and 10 is received by a discharge conveyor 11 which extends through the machine in a direction transverse to the direction of travel, normally at right angles to the direction of travel.

In the embodiment illustrated in FIGS. 1 and 2, the conveyor is telescopic, comprising an upper conveyor belt 12 which is slidingly mounted in a second frame carrying a lower conveyor belt (not shown).

Figure 3:
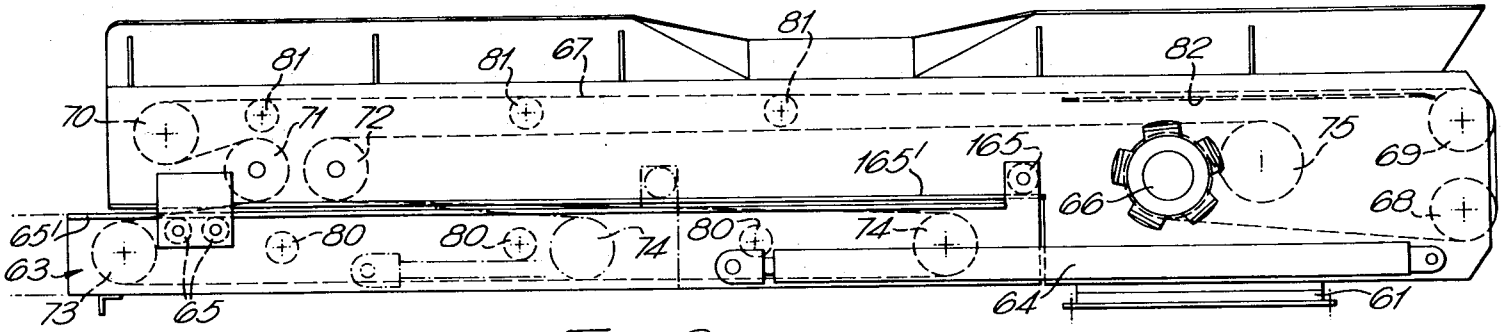
FIG. 3 is a side view of a suitable discharge conveyor for incorporation in the machine of FIGS. 1 and 2.

An alternative form of discharge conveyor is illustrated on an enlarged scale and in more detail in FIG. 3. The conveyor 11 comprises a main frame 60 which is mounted at one end by a ball race 61 on the upper deck of the main frame 1 of the machine for pivotal movement about a vertical axis by an hydraulic cylinder 62, the vertical axis coinciding with the aperture 9 or 10 in the tray 8.

The main frame 60 overlies an extension 63 which is sandwiched between the main frame 60 and the upper deck of the main frame 1 of the machine. The extension 63 is extendable between a retracted position (shown in full lines in FIG. 3) and an extended position (shown in broken lines in FIG. 3) by two hydraulic cylinders 64 one of which is illustrated. During its movement between the extended and retracted position the extension 63 is guided by two sets of rollers 65, 165 on each side of the conveyor which engage respective outwardly turned flanges 65', 165' on the edges of the extension 63 and the main frame 60.

A drive motor 66 mounted towards one end of the main frame 60 of the conveyor drives a conveyor belt 67 over two rollers 68, 69 at the near end of the main frame 60 and a return roller 70 at the remote end of the main frame 60. The conveyor belt 67 is then formed into a loop between two adjacent rollers 71, 72 on the main frame, the two ends of the loop being wrapped around respective rollers 73, 74 mounted in opposite ends of the extension 63. The belt 67 then passes from the roller 72 back to the drive motor 66 over a tensioning roller 75.

By virtue of the fact that the part of the conveyor belt in the extension 63 is in the form of a loop, the extension 63 can be advanced and retracted relative to the main frame 60 without affecting the tension in the belt 67.

Supporting rollers 80 in the extension 63 carry the belt 67 when the extension 63 is extended. A similar set of rollers 81 and a deck 82 carry the upper arm of the belt 62 in the main frame 60.

The discharge conveyor 11 may be arranged to discharge material to either side of the machine. When the conveyor is not extended, it is arranged to be at a suitable height and lateral position to unload the material directly to a stage loader assembly running the length of the roadway. The stage loader carries coal away from the working face and, when the tunnelling machine is cutting coal, the conveyor is therefore normally in the non-extended position.

When the machine is being used for cutting rock other than coal, the conveyor 11 is extended by, for example, five feet, so that the rock material is discharged automatically over the stage loader and directly into the packhole behind the seam face of coal which is being worked simultaneously as the roadway is progressed. If it is desired to track the machine forwards against the face while the rock material is still being discharged at the same place, the discharge conveyor 11 may be swivelled by up to 15° about its vertical axis of rotation.

Figure 4:
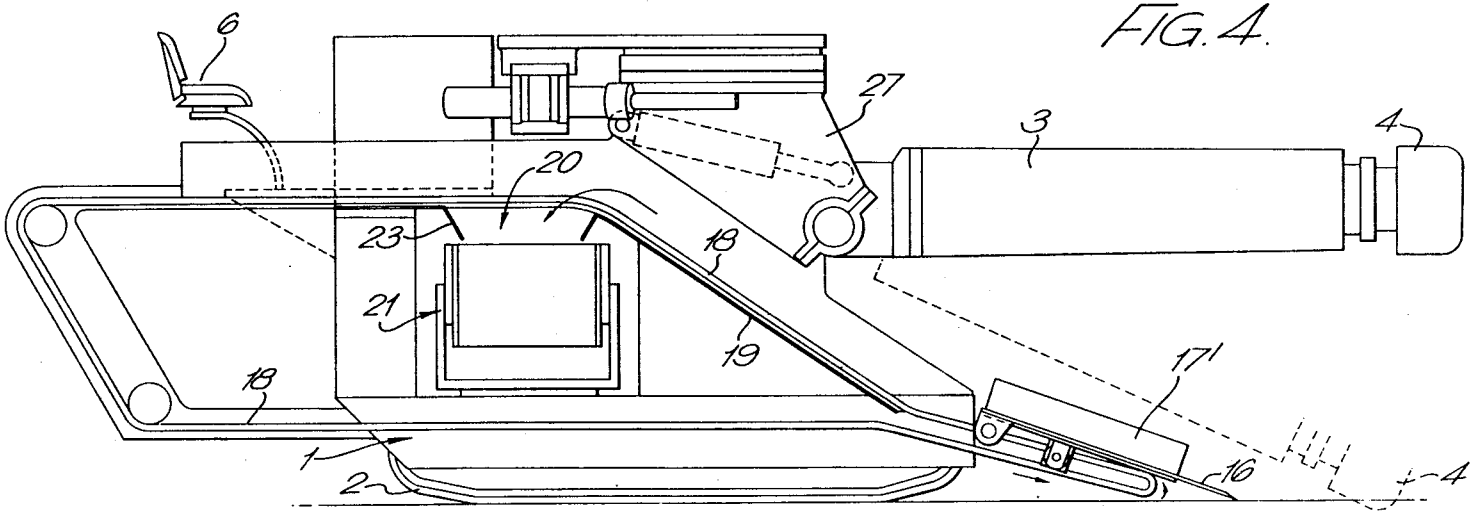
FIG. 4 is a side elevation of a second embodiment of a mining machine.
Figure 5:
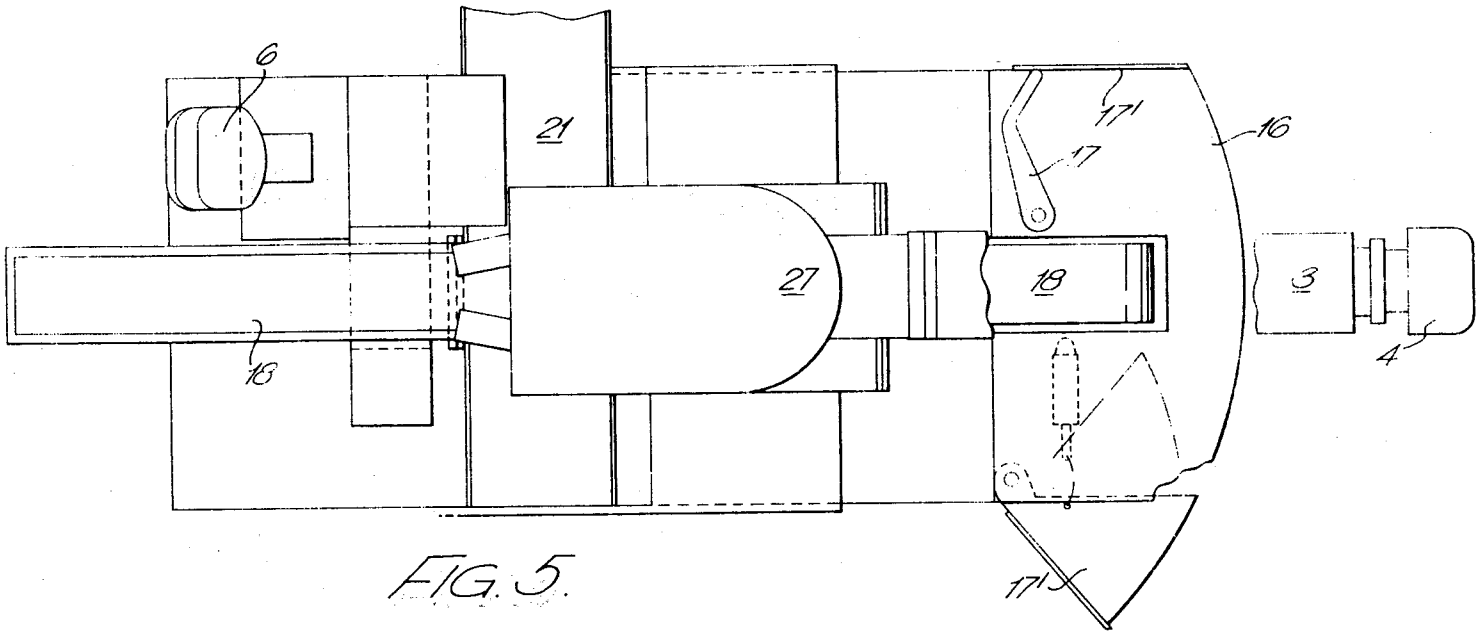
FIG. 5 is a plan view, partly cut away, of the machine of FIG. 4.

FIGS. 4 and 5 show another embodiment of the invention.

To a large extent, the machine of FIGS. 4 and 5 is similar to that of FIGS. 1 and 2 but is provided with a different means for conveying the mined material to the rear of the machine. Thus, the machine comprises a tracked main frame having a boom 3 with its associated cutting head 4, mounted for pivotal movement about horizontal and vertical axes. Material cut by the cutting head is collected by a gathering apron 16 which is provided with two gathering arms 17 (one of which has been omitted from the drawing for clarity) and pivotal side vanes 17, 17' which sweep material towards the centre of the apron 16 so that the apron is capable of loading from the full width of the heading.

Material gathered up by the apron 16 is transferred to an endless conveyor chain 18 which extends along the midlongitudinal axis of the machine and rises from the front of the machine towards the rear. The chain 18 lies in a tray 19 during the upward part of its run and an aperture 20 in the tray at its upper level allows the conveyed material to fall through on to a discharge conveyor 21. A chute 23 arranged immediately beneath the aperture 20 guides the material onto the discharge conveyor 21.

The discharge conveyor 21 is telescopic, being capable of an extension of about five feet. The conveyor also can swivel by about 15° on either side of centre and can be tilted so as to discharge into a pack from 3 feet 6 inches to 6 feet 0 inches high. Normally, the conveyor belt is about 20 inches in width and has a speed capability of from 0 - 600 feet/minute.

Figure 7:
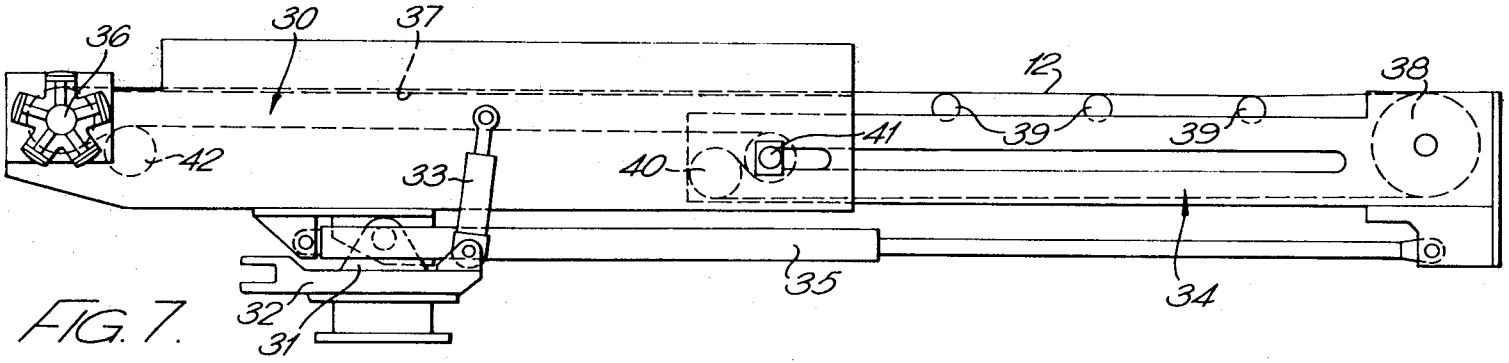
FIG. 7 is a side view of the discharge conveyor incorporated in the machine of FIGS. 5 and 6.

As best seen in FIG. 7 the conveyor 11 comprises a main frame 30 which is pivotably mounted in bearings 31 carried by a base 32 for pivotal movement about a horizontal axis by means of hydraulic cylinders 33. The base 31 is itself secured by a ball race to the deck of the main frame 1 of the mining machine thereby allowing the conveyor 11 to be rotated by means of hydraulic cylinders (not shown) about a vertical axis which is collinear with the chute 23.

A telescopic extension 34 is slidably received within the main frame 30 and is movable between an extended position, illustrated in full lines in FIG. 7, and a retracted position, illustrated in broken lines in FIG. 7, by an hydraulic cylinder 35.

A conveyor belt 12 is driven by a motor 36 carried on one end of the main frame 30. The belt 12 passes over an upper deck 37 of the main frame 30 and around a return roller 38 mounted in the opposite end of the extension 34. The upper portion of the extension 34 carries a series of rollers 39 which support the belt 12 when the extension 34 is in its extended position. From the return roller 38, the belt 12 is bent back on itself over two intermediate rollers 40, 41, the first of which, 40, is carried by the extension 34 and the second of which, 41, is carried by the main frame 30 of the conveyor. The belt then passes back to the motor 36 over a tensioning roller 42. When the extension 34 is retracted, the spacing between the intermediate rollers 40, 41 increases by an equal amount so that the tension in the belt 12 is maintained constant.

The boom 3 and the conveyor assembly 18, 19 are mounted on a sub-frame 27 which is slidable, generally by about five feet, in a longitudinal direction with respect to the main tracked frame 1 to which the operator's seat 6 and the discharge conveyor 21 are fixed. The aperture 20 in the tray 19 is sufficiently long to allow material to be deposited onto the discharge conveyor 21 throughout the whole range of movement of the sub-frame. The chute 23 is fixed to the main frame of the machine and masks those parts of the aperture 20 which do not overlie the discharge conveyor 21. The machine can therefore be held stationary for a longer period that the machine of FIGS. 1 and 2, the sub-frame 27 being used to propel the cutting head forward against the fact to be cut. Since the discharge conveyor 21 is mounted on the main frame, the packing of rubble can continue in the same area, as the cutting head is advanced. If it becomes necessary to deposit material into the packhole at a greater height, the conveyor 11 can be raised about a horizontal axis by the hydraulic cylinder 33.

Figure 6:
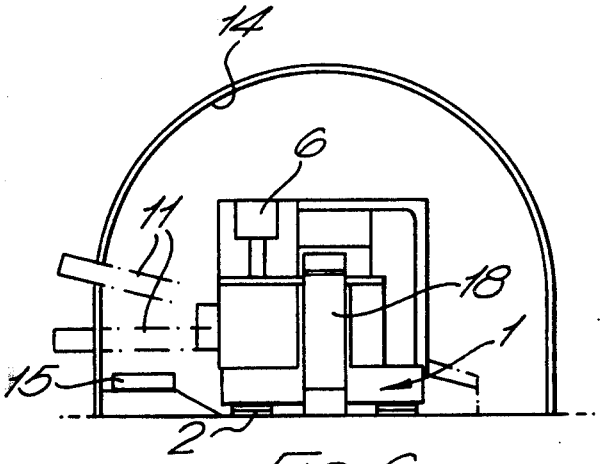
FIG. 6 is a view of the machine of FIGS. 4 and 5 when used in a roadway of a coal mine.

The machines of FIG. 1 and 2 and 4 and 5 are both used in a similar manner. FIG. 6 shows diagrammatically the operation of the machine of FIG. 5 and 6 in a roadway 14 of a mine. The conveyor 11, when not extended, unloads into a stage loader 15. The conveyor 11, in its extended position, discharges into the packhole; this figure also shows the conveyor 11 in a raised position.

A typical scheme for operating the machine in a roadway in conjunction with a face cutting machine is as follows:- The distance from the cutting head at floor level to the centre of the side discharge conveyor is arranged to be 12 feet. Two feet of coal and stone are cut to advance the roadway. The mined material is selectively loaded from the discharge conveyor, coal being deposited onto the stage loader, other material being discharged into the previously-cut packhole.

The machine is then advanced by two feet and a further two feet of coal and rubble are cut and discharged. This cut is now two feed in advance of the face line. A face machine is then used to advance by two feet the face of the "gate" formed in the coal seam adjacent the roadway and the cut coal is removed. The face machine then advances the face of the gate by a further two feet. The cycle is then repeated, arch girders being set at four feet intervals.

Figure 8:
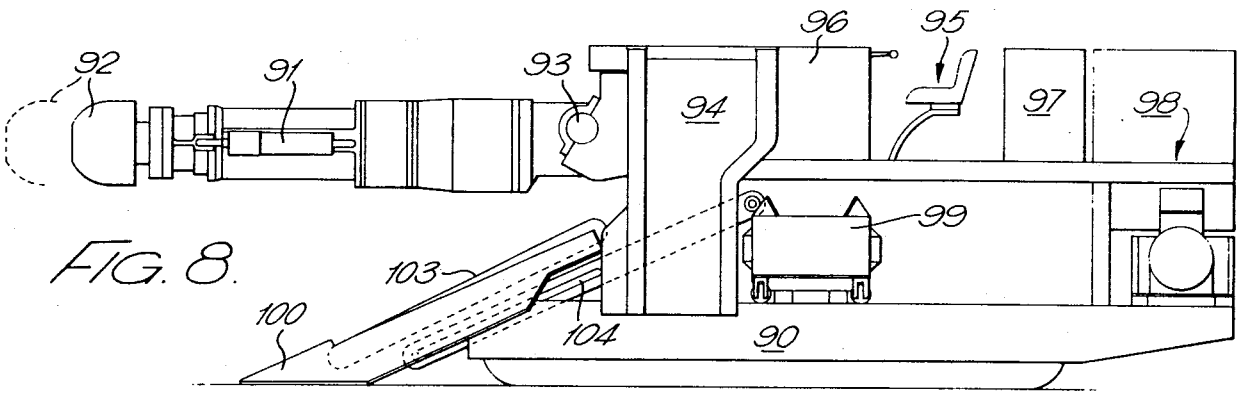
FIG. 8 is a side view of a third embodiment of a mining machine.
Figure 9:
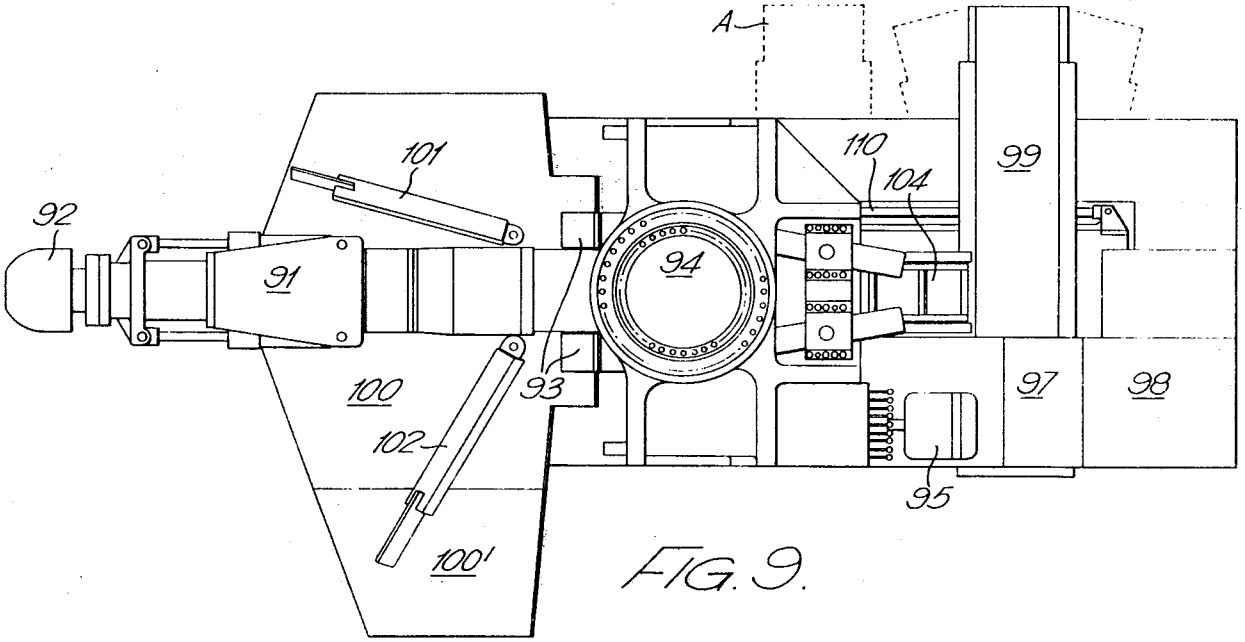
FIG. 9 is a plan of the machine of FIG. 8
Figure 10:
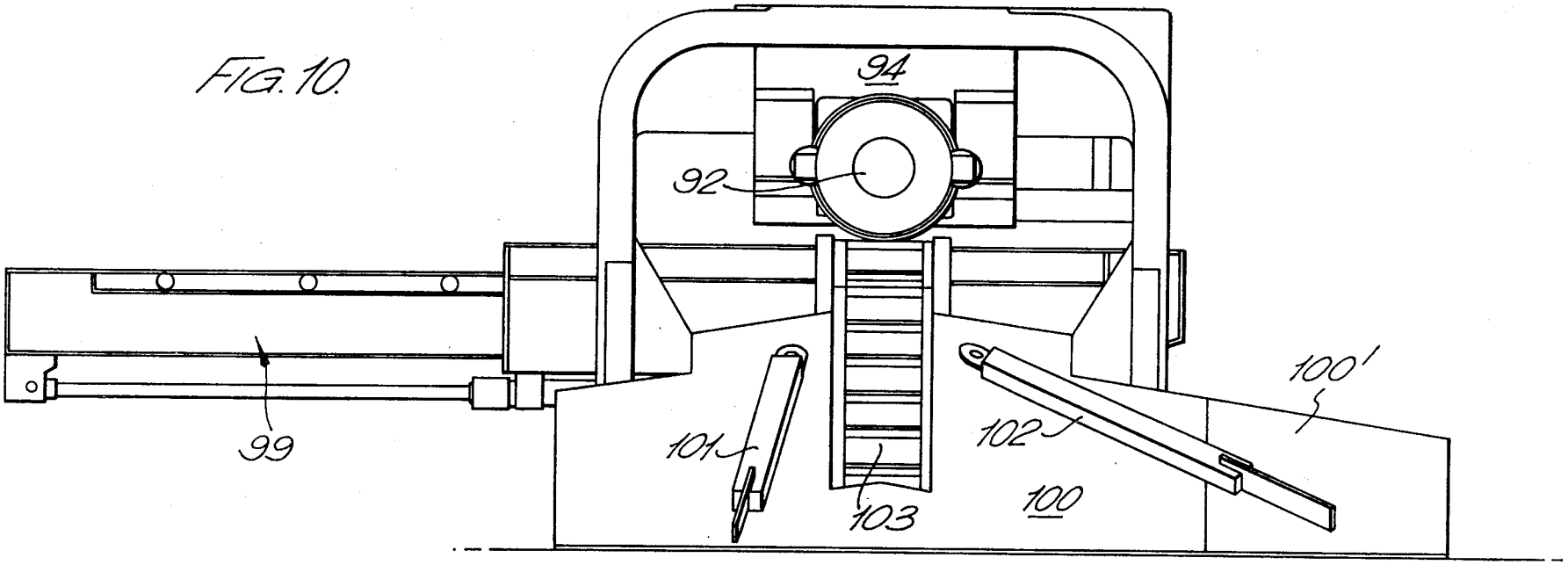
FIG. 10 is a front elevation of the machine of FIGS. 8 and 9.

Referring to FIGS. 8 to 10, the mining machine illustrated comprises a tracked main frame 90 to which is fixed a telescopic boom 91 conveying a rotatable cutting head 92. The boom 91 is mounted in bearings 93 for pivotal movement about a horizontal axis. The bearings 93 are suspended from a boom supporting structure 94 for pivotal movement about a vertical axis.

An operator's station 95, control panels 96, 97 and power pack 98 are all fixed to the main frame rearwardly of the boom supporting structure 94 and form a bridge over a discharge conveyor 99.

The discharge conveyor is identical in construction with that of FIG. 7 apart from the fact that, instead of being fixed to the upper deck of the main frame 90, it is slidable in a groove in the upper deck of the main frame 90 from the position indicated in full lines in FIG. 8 to the position indicated at A in FIG. 8 by an hydraulic cylinder 110. As indicated by the broken lines in FIGS. 8 and 9, the discharge conveyor 99 can also be rotated about vertical and horizontal axes, as more fully described with reference to FIG. 7.

As best seen in FIGS. 9 and 10, a gathering apron 100 with removable side plates 100' is fixed to the front of the main frame 90 of the machine. Two gathering arms 101, 102 traverse the apron 100 and sweep material towards a fixed central conveyor 103 which carries the material rearwardly and upwardly towards the discharge conveyor 99.

A second conveyor 104 is positioned immediately behind the fixed conveyor 103 and receives material therefrom. The discharge end of the second conveyor 104 is fixed to the discharge conveyor 99, the other end of the second conveyor being slidably mounted on the main frame so that the second conveyor 104 is movable with the discharge conveyor 99. The second conveyor 104 is therefore capable of transferring material from the fixed conveyor 103 to the discharge conveyor 99 in every position of the discharge conveyor 99 on the main frame 90.

The machine illustrated in FIGS. 8 to 10 is used in a manner similar to that of FIGS. 1 and 2 except that, when the machine is advanced, the discharge conveyor 99 may be shifted rearwardly relative to the main frame of the machine so that it can continue to discharge material into the same area.

Other modifications may be made to the machines illustrated in the accompanying drawings. For example it may in some cases be desirable to provide means for packing or ramming the rubble into the packhole. For this purpose, the extendable portions of the conveyor may themselves be constructed as a ram, the discharge end being made suitably robust. Alternatively, provision may be made to include a packing device, or slusher, at the rear of the machine.

While the discharge conveyor normally has a singlebelt wound round two fixed and two movable rollers, it is also possible to use two separate belts, each in their own framework.

Preferably, lifting jacks are provided at both front and rear ends of the machinery to enable soft floor conditions to be negotiated. Other optional features, for example lighting and dust suppression equipment, which are known for various types of mining machines may be included in machines of the present invention.

The use of a side-loading discharge conveyor, while particularly applicable to tunnelling machines of the type described, may also be applied to other machines, for example dint headers.

I claim:

1. A mining machine particularly constructed for use in cutting a roadway at an end of a working face, said mining machine having a front and back and comprising a cutting head; mounting means for said cutting head including means for moving said cutting head forwardly against a working face to be cut; means for conveying mined material towards the back of the machine; a discharge conveyor extending in a direction transverse to the front-back longitudinal direction of said mining machine; said discharge conveyor having at least one discharge end and mounting means mounting the discharge conveyor on the mining machine for relative movement of said discharge end and said cutting head in the front-back longitudinal direction whereby the cutting head may be advanced towards the working face while the discharge end of the discharge conveyor is maintained in the same location to unload material at the same selected point, and means for extending the discharge conveyor in the transverse direction whereby mined material may be unloaded at selected points disposed at different transverse distances from one side of said machine.

2. A mining machine according to claim 1 wherein said cutting head mounting means includes a boom carrying said cutting head and means for supporting said boom for pivotal movement about a vertical axis and a horizontal axis.

3. A mining machine according to claim 1 wherein said means for conveying mined material towards the back of the machine comprises a gathering apron for collecting mined material at the front of the machine; gathering arms for sweeping material on said apron towards a central position; and a feed conveyor located centrally of said apron for conveying mined material rearwardly from said apron.

4. A mining machine according to claim 1 wherein said means for conveying mined material towards the back of the machine comprises a feed conveyor for conveying mined material at the front of the machine transversely towards one side thereof and subsequently rearwardly of the machine.

5. A mining machine according to claim 4 wherein said feed conveyor comprises an endless chain conveyor encircling the front part of the machine.

6. A mining machine according to claim 1 wherein there are means mounting said discharge conveyor on said machine for pivotal movement about a horizontal axis.

7. A mining machine according to claim 1 wherein said mounting means include means mounting said discharge conveyor on said machine for rotational movement about a vertical axis.

8. A mining machine particularly constructed for use in cutting a roadway at an end of a working face, said mining machine having a front and back and comprising a cutting head; mounting means for said cutting head including means for moving said cutting head forwardly against a working face to be cut; means for conveying mined material towards the back of the machine; a discharge conveyor extending in a direction transverse to the front-back longitudinal direction of said mining machine; means for extending the discharge conveyor in the transverse direction whereby mined material may be unloaded at selected points disposed at different transverse distances from one side of said machine, and means mounting said discharge conveyor and said means for conveying mined material for movement relative to each other in the front-back direction of the machine.

9. A mining machine particularly constructed for use in cutting a roadway at an end of a working face, said mining machine having a front and back and comprising a cutting head; mounting means for said cutting head including means for moving said cutting head forwardly against a working face to be cut; means for conveying mined material towards the back of the machine; a discharge conveyor extending in a direction transverse to the front-back longitudinal direction of said mining machine; means for extending the discharge conveyor in the transverse direction whereby mined material may be unloaded at selected points disposed at different transverse distances from one side of said machine, said machine including a main frame, means mounting said means for conveying mined material towards the back of the machine on said main frame, and means mounting said discharge conveyor on said main frame for forward and rearward movement relative to said means for conveying mined material towards the rear of the machine.

10. A mining machine according to claim 9 wherein said means for conveying mined material towards the back of the machine comprises a fixed conveyor and a movable conveyor, means mounting said movable conveyor for movement with said discharge conveyor and for conveying mined material from said fixed conveyor to said discharge conveyor.

11. A mining machine according to claim 8 wherein the machine includes a main frame and a sub-frame, means mounting said sub-frame on said main frame for forward and rearward movement, said main frame carrying said discharge conveyor, said sub-frame carrying said cutting head and said means for conveying mined material towards the back of the machine.

12. A mining machine as defined in claim 1 wherein said mining machine is particularly adapted to mine recoverable material and waste materia; there is associated with said mining machine conveying means for conveying recoverable mined material from said machine; one of said selected points where mined material may be unloaded is in alignment with said conveying means for effecting delivery of recoverable mined material away from said mining machine; and another of said selected points where mined material may be unloaded is beyond said conveying means remote from said mining machine whereby waste mined material may be directed into a previously mined area.

* * * * *